US007363728B1

(12) United States Patent
McNeil et al.

(10) Patent No.: US 7,363,728 B1
(45) Date of Patent: Apr. 29, 2008

(54) SHRINK WRAP TUNNEL WITH VARIABLE SET POINTS

(75) Inventors: Dave McNeil, Canyon Country, CA (US); Michael Misik, Bradbury, CA (US)

(73) Assignee: Belco Packaging Systems, Inc., Monrovia, CA (US)

( * ) Notice: Subject to any disclaimer, the term of this patent is extended or adjusted under 35 U.S.C. 154(b) by 230 days.

(21) Appl. No.: 11/362,592

(22) Filed: Feb. 23, 2006

Related U.S. Application Data

(63) Continuation of application No. 11/186,618, filed on Jul. 20, 2005, now abandoned.

(60) Provisional application No. 60/667,577, filed on Apr. 1, 2005, provisional application No. 60/589,439, filed on Jul. 20, 2004.

(51) Int. Cl.
*F26B 19/00* (2006.01)

(52) U.S. Cl. ..... 34/381; 34/212

(58) Field of Classification Search ..... 34/381, 34/212

See application file for complete search history.

(56) References Cited

U.S. PATENT DOCUMENTS 3,673,703 A * 7/1972 Wieligmann ..... 34/225
3,721,804 A * 3/1973 Feldman ..... 219/388
3,841,100 A * 10/1974 Fortescue et al. ..... 60/690
3,866,331 A * 2/1975 Evans, Jr. ..... 34/216
4,263,725 A * 4/1981 Ganz ..... 34/231
4,363,263 A * 12/1982 Williams ..... 99/352
4,676,006 A * 6/1987 Tolson ..... 34/443
5,852,879 A * 12/1998 Schumaier ..... 34/80
6,341,708 B1 * 1/2002 Palley et al. ..... 220/1.5
7,205,016 B2 * 4/2007 Garwood ..... 426/108
7,234,586 B1 * 6/2007 Newman ..... 198/495

* cited by examiner

*Primary Examiner*—S. Gravini
(74) *Attorney, Agent, or Firm*—Christie, Parker & Hale, LLP.

(57) ABSTRACT

A shrink wrap machine has a shrink wrap tunnel with an entrance and an exit. A conveyor transports products to be shrink wrapped from the entrance through the tunnel to the exit. A source of gas is coupled to the inside of the tunnel and bathes the products. A heater controls the gas temperature in the tunnel. A pump controls the gas volume and/or velocity in the tunnel. An input device receives product identification information. A memory stores different process parameters, namely gas volumes, gas velocities, conveyor speeds, and/or temperatures applicable to the product identification information. A computer selectively retrieves process parameters from a memory responsive to the input device and sets the pump, the heater, and/or the conveyor to match the retrieved process parameters. The computer and memory are preferably a programmable logic controller (PLC). A machine readable product code such as UPC is as the product identifier and a code reader as the input device. The code reader can be "trained" by setting up the parameters once under human operator control, scanning in the product code and storing the parameters and the product code together so the parameters are recovered from the memory when the product code is applied to the input device.

8 Claims, 2 Drawing Sheets

SHRINK WRAP TUNNEL WITH VARIABLE SET POINTS

CROSS-REFERENCE TO RELATED APPLICATIONS

This application is a continuation of application Ser. No. 11/186,618 filed Jul. 20, 2005 now abandoned, which claimed the benefit of U.S. Provisional Application Nos. 60/589,439, filed Jul. 20, 2004 and 60/667,577, filed Apr. 1, 2005, the disclosures of which are incorporated fully herein.

BACKGROUND OF THE INVENTION

This invention relates to shrink wrap product packaging. The optimum parameters used in a shrink wrap tunnel depend on the packages being wrapped. Typical parameters could be conveyer speed (S), tunnel air temperature (T), tunnel air volume ($V_1$), and tunnel air velocity ($V_2$). Each time there is a change in the product being processed, the parameters must be reset, which is time consuming and subject to error.

SUMMARY OF THE INVENTION

According to the invention, a shrink wrap machine has a shrink wrap tunnel with an entrance and an exit. A conveyor transports products to be shrink wrapped from the entrance through the tunnel to the exit. A source of gas is coupled to the inside of the tunnel and bathes the products. A heater controls the gas temperature in the tunnel. A pump controls the gas volume and/or velocity in the tunnel. An input device receives product identification information. A memory stores different process parameters, namely gas volumes, gas velocities, conveyor speeds, and/or temperatures applicable to the product identification information. A computer selectively retrieves process parameters from a memory responsive to the input device and sets the pump, the heater, and/or the conveyor to match the retrieved process parameters. The computer and memory are preferably a programmable logic controller (PLC).

A feature of the invention is the use of a machine readable product code such as UPC as the product identifier and a code reader as the input device. The code reader can be "trained" by setting up the parameters once under human operator control, scanning in the product code and storing the parameters and the product code together so the parameters are recovered from the memory when the product code is applied to the input device.

DETAILED DESCRIPTION OF THE INVENTION

Figure 1:
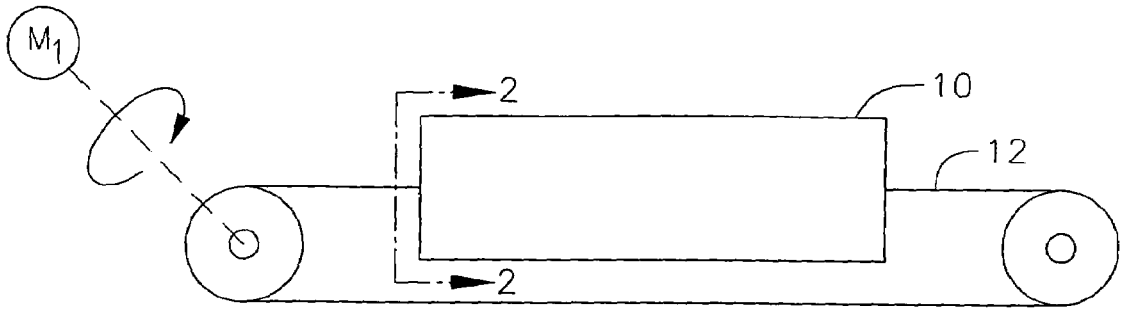
FIG. 1 is a schematic side view of a shrink wrap machine incorporating principles of the invention.

In FIG. 1, a product conveyer 12 passes through a hollow shrink wrap tunnel 10 Conveyer 12, is driven by a motor $M_1$. Motor $M_1$ has a variable speed that determines the conveyer speed (S).

Figure 2:
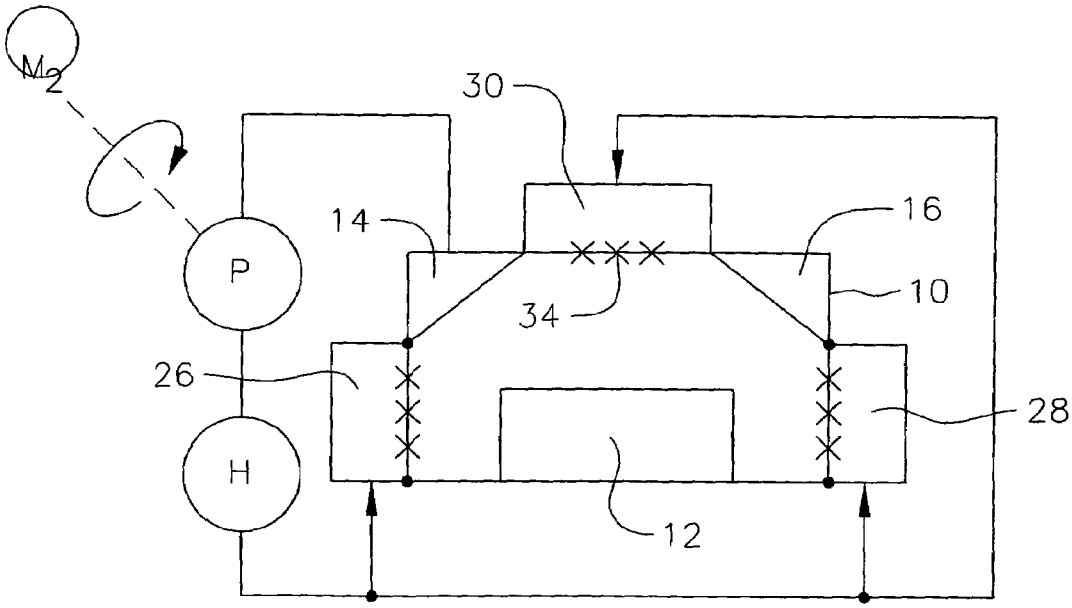
FIG. 2 is a schematic end view of the machine of FIG. 1.
Figure 3:
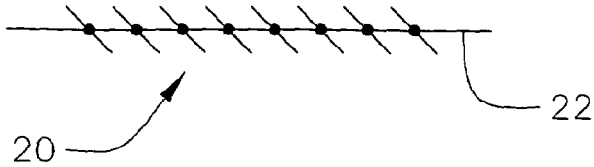
FIG. 3 is a schematic view of louvers for controlling exhaust from the machine of FIG. 1.

As shown in FIG. 2, exhaust ducts 14 and 16 are formed along the length of the corners of tunnel 10. Louvers 20 (FIG. 3) serve as inlets to each of exhaust ducts 14 and 16, respectively. As represented in FIG. 3, louvers 20 are adjusted by a linear actuator LA so the air volume ($V_1$) in tunnel 10 can be controlled.

Exhaust ducts 14 and 16 are connected to the suction side of a variable pump P. Pump P is operated by a variable speed motor $M_2$. The speed of motor $M_2$ controls the air velocity ($V_2$) in tunnel 10.

Inlet plenums 26, 28, and 30 lie adjacent to the sides and top of tunnel 10. The pressure side of pump P is connected through a heater H to plenums 26, 28, and 30. Inlets 34 (represented as crosses) connect plenums 26, 28, and 30 to the interior of tunnel 10. Heater H controls the air temperature (T) in tunnel 10. Alternatively, heater H could be located inside tunnel 10 if heater H is so arranged to heat the inside of tunnel uniformly.

Unique process parameters, i.e., set points values S, T, $V_1$, and $V_2$, are stored in a programmable logic controller (PLC) 36 for each package to be handled by tunnel 10. The product IDs are also stored in PLC 36 in linked relationship to the process parameters. Thus, when a product ID is presented to the machine, the same product ID is found in PLC 36 so the process parameters linked thereto can be accessed.

Figure 4:
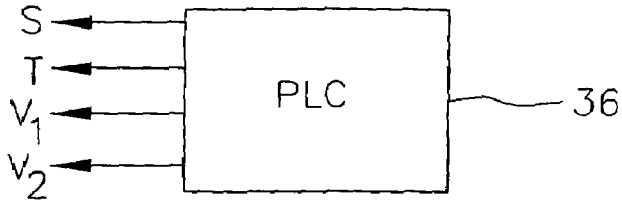
FIG. 4 is a block diagram of a programmable logic controller (PLC) for the machine of FIG. 1.

As illustrated in FIG. 4, when an operator selects a package or part number by keying in its product ID, PLC 36 locates the same product ID and set point values linked thereto. These set point values are retrieved from PLC 36 and coupled to conventional servos and sensors (not shown) that control motor $M_1$, heater H, linear actuator LA, and motor $M_2$ to establish the set point values of the selected package for the shrink wrap machine.

Thus, once the parameters used in the shrink wrap machine have been optimized for the packages being handled, the parameters can thereafter be automatically established the next time by simply keying in the product ID of the part/package number applicable to a package being processed.

The other components of a shrink wrapping machine, which are conventional, are not shown. These components include plastic film supporting and transporting means and cutting and sealing means.

Figure 5:
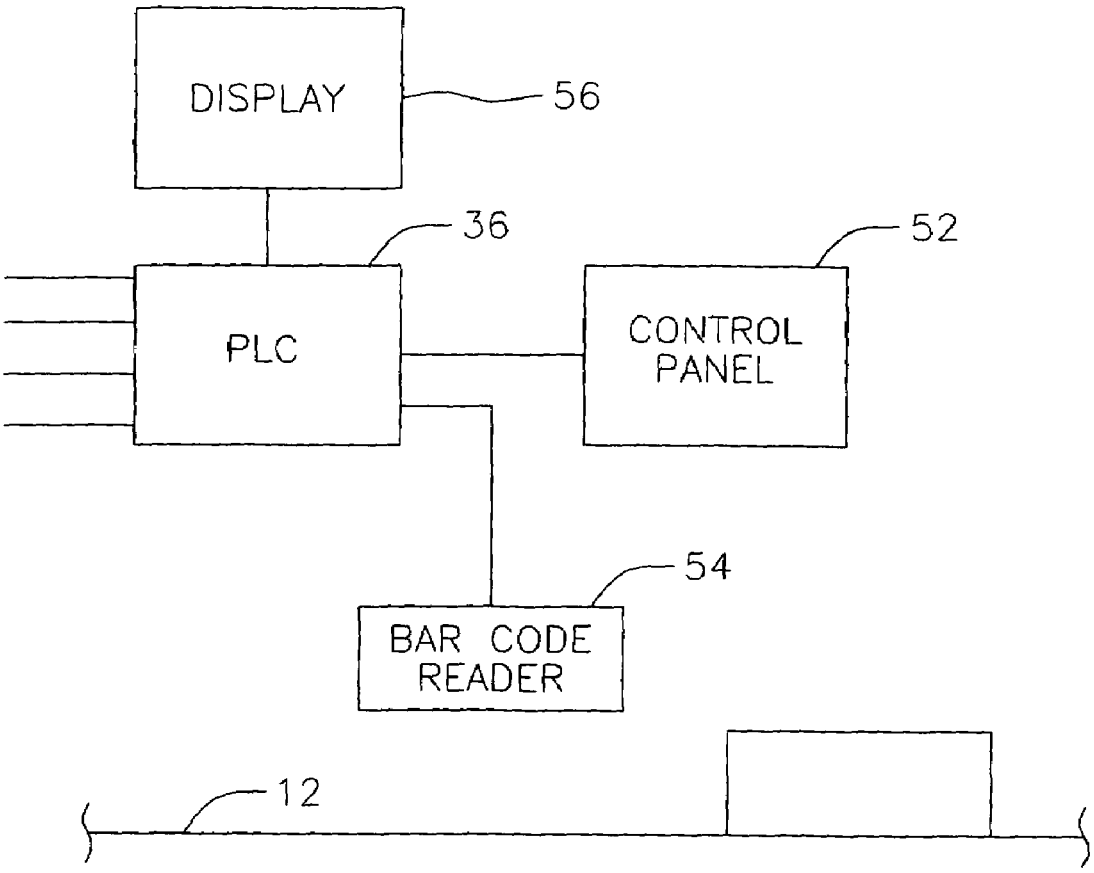
FIG. 5 is a diagram that illustrates the inputs and outputs of the PCL.

As illustrated in the embodiment of FIG. 5, the set points are automatically retrieved from PLC 36 and coupled to the servos and sensors to establish the set point values. A machine-readable identifier or code, such as a UPC bar code serves as the package ID. The identifier is in physical proximity to the package, preferably affixed to it. Specifically, a control panel 52 having input keys to enter package IDs, a bar code reader 54, and a display device 56 are connected to PLC 36. Bar code reader 54 is located near conveyer 12 (FIG. 1) so it can read the codes on packages 58, which are carried by conveyor 12, as packages 58 pass by. This permits tunnel 10 to process different products on the fly without manual adjustment of the set points. Alternatively, to "train" the machine to reset for a product change, one of packages 58 could be held by the operator and swiped passed bar code reader 54 to establish the set points each time a new package type is run through tunnel 10. The process parameters can also be adjusted by keying in the package ID or the parameters themselves into control panel 52. A human operator can monitor the process by viewing display device 56. Other machine readable codes and readers could be used, instead of UPC, if desired.

When tunnel 10 is operated in tandem with other packaging equipment, such as the machine disclosed in patent application Ser. No. 10/465,989, filed on Jan. 30, 2004 (the disclosure of this application is incorporated herein by reference), the process settings for the other machine can also be stored in PCL 36 and used to establish the parameters of the other machine. Basically, one package ID is entered into PCL 36 for the entire operation.

In some cases, it may not be necessary to reset all the parameters each time the product being processed changes. When the term "and/or" is used in connection with the parameters herein, it means that any of the parameters can be disregarded. The invention is also applicable to a shrink wrap process in which one or more other parameters, e.g., conveyor or product temperature, are reset for different products.

What is claimed is:

1. A shrink wrap machine comprising:

a shrink wrap tunnel having an entrance and an exit;

a conveyor for transporting products to be shrink wrapped from the entrance through the tunnel to the exit;

a source of gas coupled to the inside of the tunnel so as to bathe the products in the gas;

a heater that controls the gas temperature in the tunnel;

a pump that controls the gas volume and/or velocity in the tunnel;

an input device that receives product identification information;

a memory that stores different process parameters, namely gas volumes, gas velocities, conveyor speeds, and/or temperatures applicable to the product identification information; and a programmable logic controller responsive to the input device for selectively retrieving process parameters and setting the pump, the heater, and/or the conveyor to match the retrieved process parameters.

2. The shrink wrap machine of claim 1, in which the input device is a machine code reader.

3. The shrink wrap machine of claim 2, in which the machine code reader is a UPC reader.

4. The shrink wrap machine of claim 1, in which the input device is a control panel having input keys.

5. A method for operating a shrink wrap machine comprising:

passing products to be shrink wrapped through a shrink wrap tunnel;

introducing gas into the tunnel to control the temperature therein;

heating the gas introduced into the tunnel;

storing for each package being processed by the machine values representing process parameters of the machine, namely the product speed through the tunnel, the gas volume in the tunnel, the gas velocity in the tunnel, and/or the gas temperature in the tunnel; and operating the machine responsive to one or more of the stored parameters applicable to a package being processed.

6. The method of claim 5, in which the operating additionally storing package IDs in linked relationship to the respective parameters.

7. The method of claim 6, additionally comprising keying in package IDs to an input device that retrieves stored parameters.

8. The method of claim 6, additionally comprising scanning a machine readable code over the packages to create the package IDs.

* * * * *